US005572086A

United States Patent [19]

Tong et al.

[11] Patent Number: 5,572,086

[45] Date of Patent: Nov. 5, 1996

[54] BROADBAND ANTIREFLECTIVE AND ANTISTATIC COATING FOR CRT

[75] Inventors: Hua-Sou Tong, Arlington Heights, Ill.; Chun-Min Hu, Keelung; Yu-Chung Yu, Chungli, both of Taiwan

[73] Assignee: Chunghwa Picture Tubes, Ltd., Taoyuan, Taiwan

[21] Appl. No.: 443,440

[22] Filed: May 18, 1995

[51] Int. Cl.[6] ..... H01J 29/86

[52] U.S. Cl. ..... 313/478; 313/479; 445/58; 427/126.1; 427/256; 427/331

[58] Field of Search ..... 313/110, 112, 313/478, 479; 445/24, 58; 427/126.1, 126.2, 106, 108, 110, 256, 343, 344, 352, 353, 331; 359/577, 580

[56] References Cited

U.S. PATENT DOCUMENTS

| | | | |
|---|---|---|---|
| 2,522,531 | 9/1950 | Mochel . | |
| 2,564,677 | 8/1951 | Davis . | |
| 2,564,707 | 8/1951 | Mochel . | |
| 2,564,709 | 8/1951 | Mochel . | |
| 2,564,710 | 8/1951 | Mochel . | |
| 2,808,351 | 10/1957 | Colbert et al. . | |
| 2,833,902 | 5/1958 | Gaiser et al. . | |
| 2,852,415 | 9/1958 | Colbert et al. . | |
| 2,919,212 | 12/1959 | Gaiser . | |
| 3,093,598 | 6/1963 | McMillan et al. . | |
| 3,252,829 | 5/1966 | Romstadt et al. . | |
| 4,263,335 | 4/1981 | Wagner et al. | 427/29 |
| 4,393,095 | 7/1983 | Greenberg | 427/87 |
| 4,490,227 | 12/1984 | Bitter | 204/192 SP |
| 4,649,126 | 3/1987 | Gaprindashvili et al. | 501/43 |
| 4,650,557 | 3/1987 | Bitter | 204/192.12 |
| 4,987,338 | 1/1991 | Itou et al. | 313/478 |
| 5,099,171 | 3/1992 | Daiku et al. | 313/479 |
| 5,122,709 | 6/1992 | Kawamura et al. | 313/479 |
| 5,189,337 | 2/1993 | Endo et al. | 313/479 |
| 5,241,097 | 8/1993 | Zupancic et al. | 556/460 |
| 5,254,904 | 10/1993 | Van De Leest et al. | 313/479 |
| 5,279,851 | 1/1994 | Minosou et al. | 427/126.2 |
| 5,404,073 | 4/1995 | Tong et al. | 313/479 |

FOREIGN PATENT DOCUMENTS

| | | |
|---|---|---|
| 0585819 | 3/1994 | European Pat. Off. . |

*Primary Examiner*—Nimeshkumar Patel
*Attorney, Agent, or Firm*—Emrich & Dithmar

[57] ABSTRACT

The outer surface of the glass display panel of a cathode ray tube (CRT) is first coated with an antistatic conductive metal salt solution. A water or organic solvent soluble antireflective coating is then applied by conventional means such as spinning, spraying or dipping to the glass display panel over the first coating. The antireflective coating is comprised of either an organic or an inorganic salt, or a polymer. The coated display panel is then baked, followed by thorough washing with either water in the case of an organic or inorganic salt or water soluble polymer antireflective coating, or toluene in the case of a non-water soluble polymer antireflective coating. Washing the display panel partially dissolves the salt or polymer in the antireflective coating more on the outer surface of the coating than on the inner portion of the coat adjacent the glass facelate. Dissolution of a portion of the salt or polymer in the coating produces pores in the coating and variations in coating thickness, thus changing the light refractive index of the coating. A continuous decreasing dissolution rate determined by the extent of washing of the coated display panel provides the coating with a continuous decreasing light refractive index and broadband antireflection (400–700 nm) with a minimum reflectance of 1.0% in the range of 560–650 nm. Knowing the light refractive index of the glass substrate and that of air (typically 1.0), the refractive index of the salt or polymer coating may be established by the extent of dissolution of the coating during washing.

16 Claims, 2 Drawing Sheets

BROADBAND ANTIREFLECTIVE AND ANTISTATIC COATING FOR CRT

FIELD OF THE INVENTION

This invention relates generally to video display panels such as in a cathrode ray tube (CRT) and as particularly directed to a broadband antireflective and antistatic coating for the outer surface of a CRT display panel.

BACKGROUND OF THE INVENTION

CRTs are perhaps the most common video display device and have found widespread use in television receivers and computer terminals. The increasing emphasis on ergonomics is placing increasing demands upon the CRT in these environments, as well as in other applications in which the CRT is employed. One ergonomic factor of CRTs is the extent incident light is reflected from the CRT's display panel, or faceplate, to the viewer or user. Light reflected from the faceplate makes it more difficult to view a video image produced by the CRT. Ideally, reflection of light in the visible light wavelength range of 400–700 nm should be minimized for optimum viewing of the CRT. Typical antireflective coatings applied to the outer surface of the CRT's glass display screen are based upon negative reflective light interference wherein reflected light coming from the coating surface and the glass substrate surface under the coating cancel each other for minimizing light reflection. There are typically two types of antireflective coatings, broadband and narrow band antireflective coatings. While broadband antireflective coatings are preferred because of the reduced reflection they afford over the visible light spectrum, the high manufacturing costs of current broadband antireflective coatings requiring complicated and expensive vacuum deposition processes precludes the widespread commercial use of these types of coatings. The conventional liquid spin method of coating application used in depositing narrow band antireflective coatings has not been adapted for use in applying broadband antireflective coatings.

The present invention addresses the aforementioned limitations of the prior art by providing an antireflective and antistatic coating for the outer surface of a CRT glass display panel which reduces ambient light reflection over the entire visible spectrum. An inner antistatic coating and outer broadband antireflective coating may be applied by conventional means such as spinning, spraying or dipping, with the antireflective coating provided with a continuous decreasing light refractive index for broadband light reflection suppression.

OBJECTS AND SUMMARY OF THE INVENTION

Accordingly, it is an object of the present invention to provide a broadband antireflective and antistatic coating for the outer surface of a CRT glass display panel.

It is another object of the present invention to establish the light refractive index of a coating on the outer surface of a CRT glass display panel so as to minimize reflection of light by forming pores or voids in the coating on the display panel.

Yet another object of the present invention is to provide an outer coating for a glass video display panel with broadband antireflection (i.e., 400–700 nm), having a minimum reflectance of 1.0% between 560–650 nm, and high resistivity (on the order of $10^7$ ohm-cm) for dissipating static charge.

A further object of the present invention is to establish a light refractive index of the surface coating of a video display panel by dissolving a portion of the coating such as washing so as to provide pores or voids having a range of depths and thus a continuously changing light refractive index for broadband antireflection.

This invention contemplates an antireflective/antistatic coating and a method of applying the antireflective/antistatic coating to a glass video display panel comprising the steps of:

preheating the display panel; applying a conductive metal salt coating to the heated display panel; applying a water soluble organic or inorganic salt antireflective coating or a polymer antireflective coating to the display panel over the conductive metal salt coating; and washing the organic or inorganic salt coating with water or the polymer coating with toluene so as to partially dissolve the organic or inorganic salt coating or the polymer coating and form pores in the antireflective coating, whereby the light refractive index of the antireflective coating is established by the extent of pore formation in the coating.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
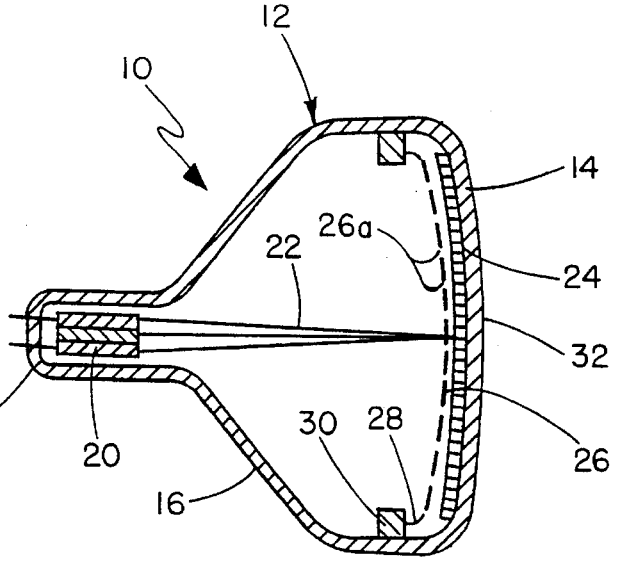
FIG. 1 is a sectional view of a color cathode ray tube incorporating a broadband antireflective and antistatic coating in accordance with the principles of the present invention.

Referring to FIG. 1, there is shown a sectional view of a color CRT 10 incorporating an antireflective/antistatic coating 32 in accordance with the principles of the present invention. CRT 10 includes a sealed glass envelope 12 having a forward display panel or display screen 14, an aft neck portion 18, and an intermediate funnel portion 16 The terms "faceplate" "display screen", and "display panel" are used interchangeable in the following discussion. Disposed on the inner surface of glass display screen 14 is a phosphor screen 24 which includes a plurality of discrete phosphor deposits, or elements, which emit light when an electron beam is incident thereon to produce a video image on the display screen. Disposed in the neck portion 18 of the CRT's glass envelope 12 are a plurality of electron guns 20 typically arranged in an inline array for directing a plurality of electron beams 22 onto phosphor screen 24. The electron beams 22 are deflected vertically and horizontally in unison across the phosphor screen 24 by a magnetic deflection yoke which is not shown in the figure for simplicity. Disposed in a spaced manner from phosphor screen 24 is a shadow mask 26 having a plurality of spaced electron beam passing apertures 26*a* and a skirt portion 28 around the periphery thereof. The shadow mask skirt portion 28 is securely attached to a shadow mask mounting fixture 30 around the periphery of the shadow mask. The shadow mask mounting fixture 30 is attached to an inner surface of the CRT's glass envelope 12 and may include conventional attachment and positioning structures such as a mask attachment frame and a mounting spring which also are not shown in the figure for simplicity. The shadow mast mounting fixture 30 may be attached to the inner surface of the CRT's glass envelope 12 and the shadow mask 26 may be attached to the mounting fixture by conventional means such as weldments or a glass-based frit.

Figure 2:
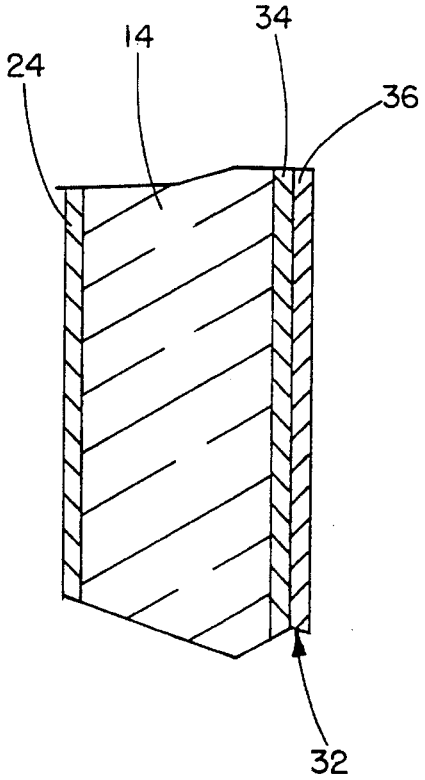
FIG. 2 is a partial sectional view showing a broadband antireflective and antistatic coating in accordance with the present invention disposed on the outer surface of a CRT's display screen.
Figure 3:
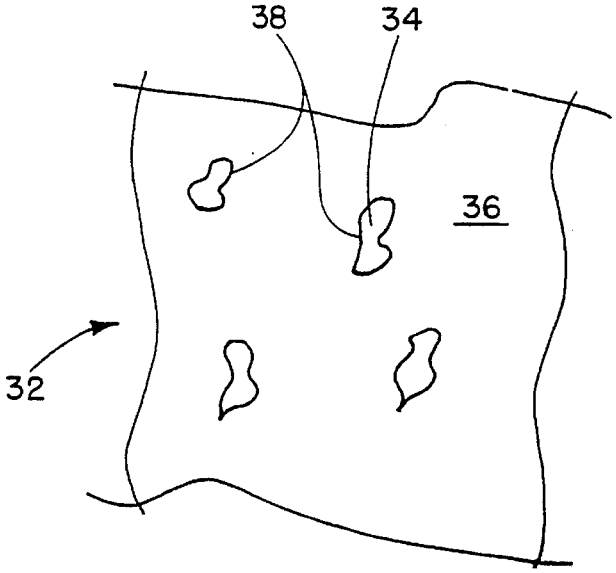
FIG. 3 is a simplified plan view of a portion of the inventive broadband antireflective and antistatic coating of the present invention.

In accordance with the present invention and with reference also to the sectional view of FIG. 2, the antireflective/antistatic coating 32 is disposed on the outer surface of the CRT's glass display screen 14. Disposed on the inner surface of glass display screen 14 is the aforementioned phosphor screen 24. The antireflective/antistatic coating 32 includes a first inner antistatic layer, or coating, 34 and a second outer antireflective layer 36. The first inner antistatic layer 34 is preferably comprised of a conductive metal salt such as antimony-tin oxide (Sb—$SnO_2$) and is coupled to neutral ground potential. The antistatic properties of the first inner layer 34 arise from its conductive metal composition. To provide an effective antistatic capability on the CRT's display panel 14, the first inner antistatic layer 34 has an electrical resistance on the order of $10^7$ ohm-cm.

In applying the first inner antistatic layer 34 to the CRT's glass display panel 14, the display panel is first cleaned using a conventional cleansing agent such as cerium oxide followed by thorough rinsing of the display panel. The display panel is then preheated to a temperature on the order of 40° C. prior to applying the first inner antistatic layer 34 to the outer surface of the display panel. The first inner antistatic layer 34 is applied to the display panel 14 either by spinning or spraying the coating onto the display panel. The first inner antistatic layer 34 is applied to the display panel's outer surface and is in contact with either a grounded implosion protection band disposed about the display panel or with conducting tape connected to the implosion protection band, which is not shown in the figure for simplicity. After applying the first inner antistatic layer 34 to the display panel's outer surface, the coated display panel is then aged either at room temperature or is maintained at a temperature in the range of 60°–100° C. to allow for drying and hardening of the antistatic layer.

In accordance with the present invention, the broadband antireflective coating 32 is comprised of an organic or inorganic salt or a polymer. The organic or inorganic salt or polymer is preferably water soluble, or soluble in an organic solvent. An example of an organic salt which is water soluble for use in the inventive broadband antireflective coating 36 is maleic anhydride and maleic acid. Examples of water soluble inorganic salts for use in the broadband antireflective coating 36 of the present invention include sodium chloride (NaCl), cupric sulfate ($CuSO_4$) and calcium chloride ($CaCl_2$). Examples of water soluble polymers for use in the broadband antireflective coating 36 of the present invention include polyvinyl alcohol and polyvinyl pyridine, while an example of a toluene soluble polymer for use in the present invention is polyacrylate. In the preferred embodiment, at least one of the above mentioned salts or a combination of said salts, in the amount of 0.1–6 wt % is added to a solution containing 6.0 wt % tetraethoxy silane (TES), 10 wt % water, 1 wt % $HNO_3$, which is balanced with an alcohol mixture.

Figure 4:
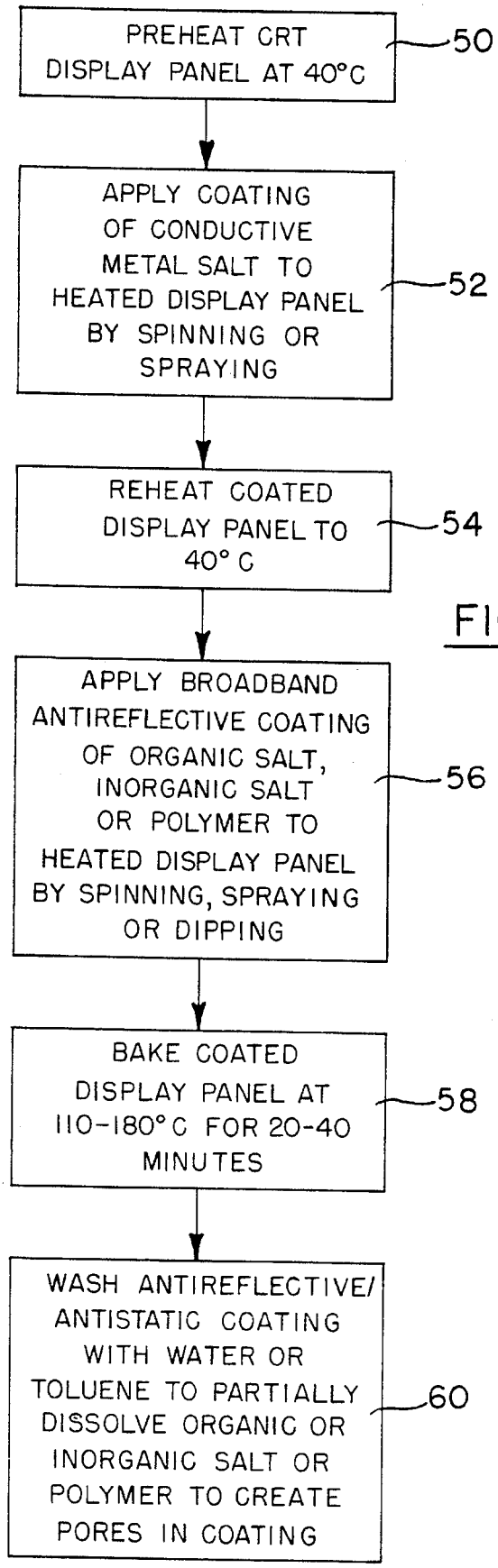
FIG. 4 is a simplified flowchart in block diagram form illustrating the steps involved in preparing and applying the broadband antireflective and antistatic coating of the present invention to the outer surface of a CRT display screen.

Referring to FIG. 4, there is shown in a simplified block diagram form a flow chart illustrating the steps involved in preparing and applying a broadband antireflective and antistatic coating to the glass display panel of a CRT in accordance with the present invention. The display panel of the CRT is initially preheated to a temperature on the order of 40° C. at step 50. The display panel is then coated by either a conventional spin or spray method at step 52 with a layer of conductive metal salt. In the preferred embodiment, the conductive metal salt applied to the outer surface of the glass display panel is antimony-tin oxide (Sb-$SnO_2$). The display panel is then reheated to on the order of 40° C. at step 54 followed by the application of broadband antireflective coating of an organic or inorganic salt or a polymer in accordance with the present invention to the heated display panel at step 56. At step 58, the coated display panel is then baked at a temperature in the range of 110°–180° C. for 20–40 minutes, followed by air cooling of the display panel.

In accordance with the present invention, the final step of the inventive process for preparing and applying the broadband antireflective and antistatic coating for a CRT display panel involves a thorough washing of the display panel at step 60. The liquid for display panel washing depends upon the type of salt or polymer added to the coating solution. Water is the liquid used in washing the display panel if the coating solution contains an organic or inorganic salt. In some cases, water may also be used as the washing agent were the antireflective coating includes a polymer such as polyvinyl alcohol or polyvinyl pyridine. Where another polymer which is not water soluble is included in the antireflective coating, a solvent such as toluene may be used to wash the antireflective/antistatic coating at step 60. The water or toluene washing agent dissolves a portion of the organic or inorganic salt or the polymer in the antireflective coating, where the degree of the dissolution is a function of the coating depth, with the salt adjacent to the outer surface of the coating dissolving to a greater extent than the salt disposed adjacent to the glass display panel. The dissolution of the salt or polymer within the outer antireflective coating creates pores in the coating giving raise to a change in the light refractive index of the antireflective/antistatic coating on the glass display panel. The continuous decreasing dissolution rate of the salt or polymer as a function of coating depth gives rise to a continuous decreasing light refractive index in the antireflective/antistatic coating providing the surface coating for the glass display panel with a broadband antireflective characteristic.

In a specific example of the present invention, 0.3 wt % of polyvinyl alcohol (PVA) was added to a solution containing 6 wt % TES, 10 wt % water, 1 wt % $HNO_3$, which solution was balanced with an alcohol mixture. The glass display panel was then preheated to a temperature of 40° C., coated with a layer of Sb-$SnO_2$ solution, reheated again to 40° C. and spin coated with the inventive broadband antireflective coating containing a water soluble salt. The glass display panel was then dried and several measurements were made. The electrical resistance was measured to be in the range of $10^7$ ohm-cm. The reflectance of the glass display panel prior to applying the broadband antireflective/antistatic coating of the present invention was measured at 4.5%. With the broadband antireflective/antistatic coating applied to the glass display panel, a minimum reflectance of 1.0% in the range of 560–650 nm was measured as shown in FIG. 5.

There has thus been shown the preparation and application of a broadband antireflective and antistatic coating to the surface of a glass display panel such as of a CRT. The antireflective/antistatic coating includes an inner conductive layer containing a metal salt. The antireflective/antistatic coating further includes an outer layer including either an organic or inorganic salt, or a polymer. The organic or inorganic salt is water soluble. The polymer may be either water soluble or soluble in an organic solvent such as toluene. After the outer antireflective coating is applied over the inner electrically conductive coating, the display panel is then baked and air cooled. The final step involves washing the coated display panel with either water or toluene for removing the organic or inorganic salt, or the polymer. The degree of dissolution and removal of the salt or polymer depends upon the extent of washing of the coating which produces pores, or voids, in the coating. These pores give rise to changes in the light refractive index of the coating, with a greater dissolution of the salt or polymer occurring near the outer surface of the coating. A continuous decreasing dissolution rate of the salt or polymer in the coating as a function of coating depth gives rise to a continuous decreasing light refractive index in the coating to provide a broadband antireflective characteristic in the coating.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A method of applying an antireflective/antistatic coating to a glass video display panel comprising the steps of:

preheating the display panel;

applying a conductive metal salt coating to the heated display panel;

applying a water soluble organic or inorganic salt antireflective coating or a polymer antireflective coating to the display panel over said conductive metal salt coating; and washing said organic or inorganic salt coating with water or said polymer coating with toluene so as to partially dissolve the organic or inorganic salt coating or the polymer coating and form pores in the antireflective coating, whereby the light refractive index of the antireflective coating is established by the extent of pore formation in said coating.

2. The method of claim 1 wherein said water soluble organic salt is comprised of maleic anhydride and maleic acid.

3. The method of claim 1 wherein said water soluble inorganic salt comprises NaCl, $CuSO_4$ or $CaCl_2$.

4. The method of claim 1 wherein said polymer is comprised of polyvinyl alcohol, polyvinyl pyridine or polyacrylate.

5. The method of claim 1 further comprising the step of adding said organic or inorganic salt or said polymer to a solution of 6.0 wt % tetraethoxy silane, 10 wt % water, 1 wt % $HNO_3$, and balanced with an alcohol mixture.

6. The method of claim 5 wherein the display panel is preheated to a temperature of 40° C.

7. The method of claim 6 further comprising the step of reheating the display panel to a temperature of 40° C. prior to applying said organic or inorganic salt or said polymer antireflective coating to the display panel.

8. The method of claim 7 further comprising the step of baking the display panel after said organic or inorganic salt or said polymer antireflective coating is applied at a temperature in the range of 110°–180° C. for 20–40 minutes.

9. The method of claim 1 wherein said conductive metal salt coating is applied by spinning or spraying onto the display panel.

10. The method of claim 1 wherein said antireflective coating is applied by spinning, spraying or dipping onto the display panel.

11. For use on an outer surface of a glass display panel of a cathode ray tube (CRT), a multi-layer coating comprising:

a first conductive grounded inner coating disposed on the outer surface of the display panel, said first conductive inner coating including a metal salt; and a second outer coating disposed on said first inner coating and having a characteristic light refractive index, said second outer coating comprised of a water soluble organic or inorganic salt or polymer, or a polymer soluble in an organic solvent, said outer coating having a plurality of pores of various depths therein for providing said outer coating with a range of light refractive indexes determined by the depths of said pores for reducing light reflection from the display panel over the visible light spectrum.

12. The coating of claim 11 wherein said first inner coating comprises Sb-$SnO_2$.

13. The coating of claim 11 wherein said second outer coating includes a water soluble organic salt comprised of maleic anhydride and maleic acid.

14. The coating of claim 11 wherein said second outer coating includes a water soluble inorganic salt comprised of NaCl, $CuSO_4$ or $CaCl_2$.

15. The coating of claim 11 wherein said second outer coating includes a polymer comprised of polyvinyl alcohol, polyvinyl pyridine or polyacrylate.

16. The coating of claim 11 wherein said organic or inorganic salt or said polymer is in a solution of 6.0 wt % tetraethoxy silane, 10 wt % water, 1 wt % $HNO_3$ and balanced with an alcohol mixture.

* * * * *